US005236180A

United States Patent [19]

Lazcano-Navarro et al.

[11] Patent Number: 5,236,180

[45] Date of Patent: Aug. 17, 1993

[54] WATER COOLING IN INDUCTION HEATING FURNACES

[75] Inventors: Arturo Lazcano-Navarro; Antonio Lazcano-Ponce; Rafael Arellano-Valdes, all of Coahuila, Mexico

[73] Assignee: Instituto Mexicano de Investigaciones Siderurgicas, Mexico

[21] Appl. No.: 748,073

[22] Filed: Aug. 21, 1991

[51] Int. Cl.[5] ..... C21B 3/00

[52] U.S. Cl. ..... 266/275; 75/10.14; 75/10.18; 164/53

[58] Field of Search ..... 75/10.14–10.18; 164/53, 254, 256; 266/275

[56] References Cited

U.S. PATENT DOCUMENTS 3,519,059 7/1970 Voskoboinikov ..... 164/53

*Primary Examiner*—Peter D. Rosenberg

*Attorney, Agent, or Firm*—Laurence R. Brown

[57] ABSTRACT

The present invention relates to a device that heats liquid steel by means of induction in the tundishes of horizontal continuous casting machines.

5 Claims, 1 Drawing Sheet

WATER COOLING IN INDUCTION HEATING FURNACES

BACKGROUND OF THE INVENTION

In the operation of the horizontal continuous casting machines, and especially in the ministeel works, the thermal losses of liquid steel play an important role in the techno-economic indicators of the process, thus affecting the productivity.

To lower this effect it is usually necessary to apply overheatings in the order of 100° C. to 150° C. above the liquids temperature of the steel casting.

The invention referred in this patent has the object of compensating the thermal losses present in the tundishes, working between the same temperature range and obtaining in this way longer casting times and larger number of sequence heatings, thus improving the quality of the product. Additionally, a refractory sleeve (monolithic, isostatically pressed) optimizes the joint between the tundish and the mold to discharge the liquid steel.

DESCRIPTION OF THE INVENTION

Figure 1:
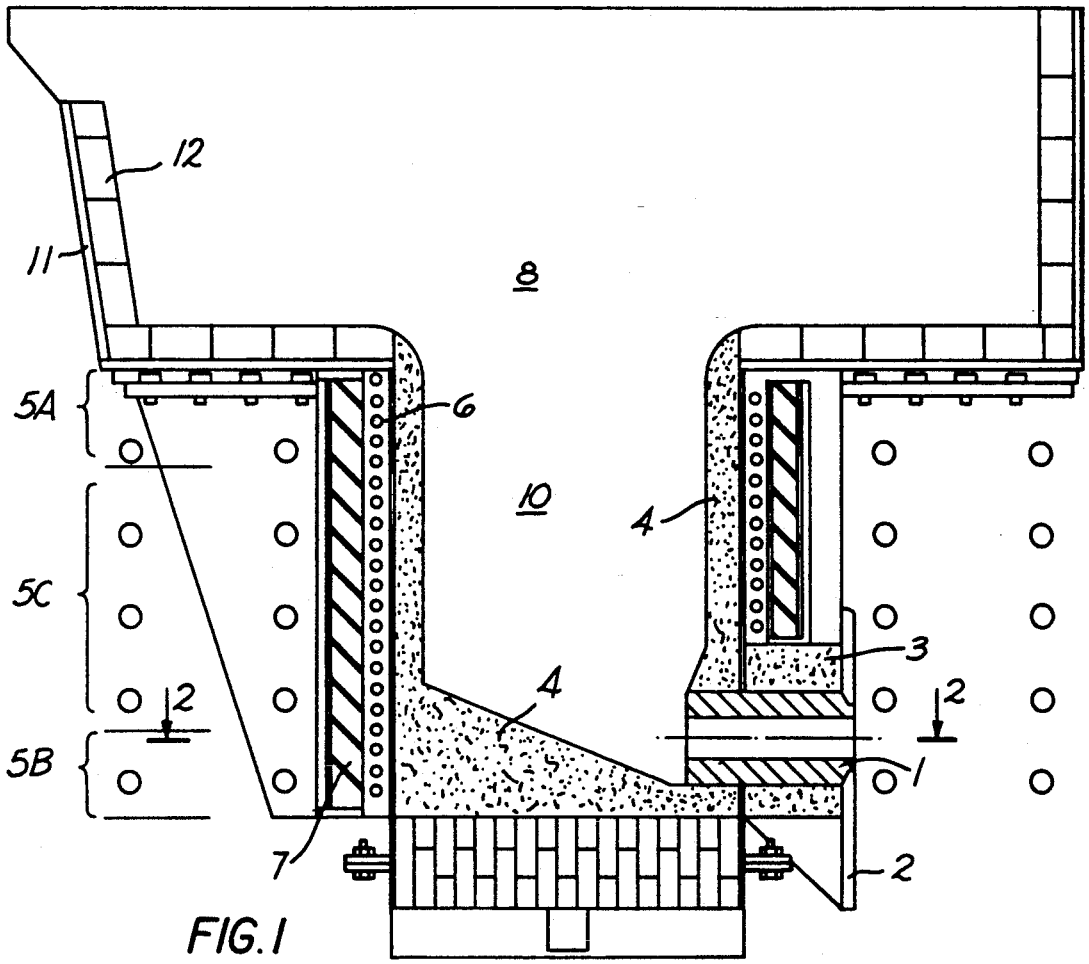
FIG. 1. shows a cross sectional view of the tundish.
Figure 2:
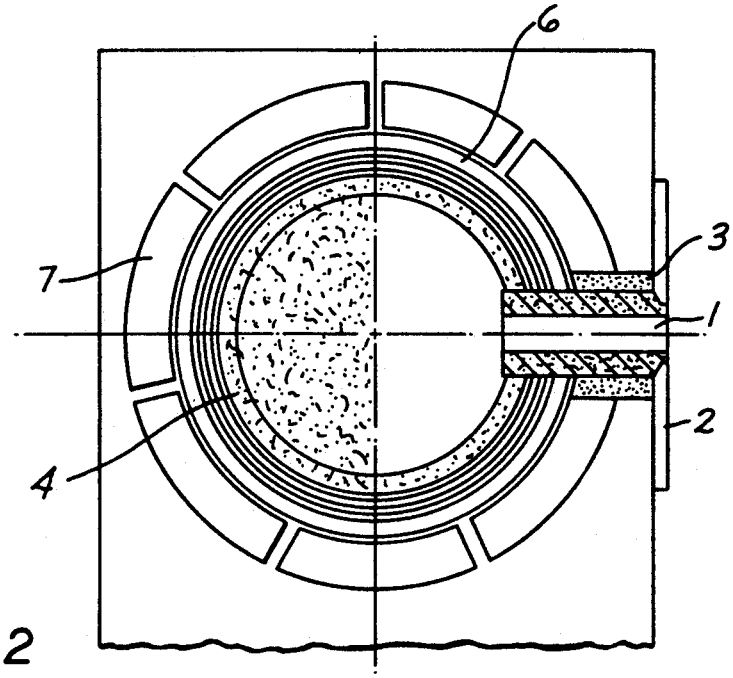
FIG. 2. shows a top view of the tundish.

Referring to the drawings, the device object of this application comprises in combination two main parts; the tundish (8) and the inductor (10), and which, also comprises in combination a cylindrical refractory sleeve joint (1) which forms the discharge channel, placed between the molding (3) and the lower part of the inductor (10).

Installed into the inductor (10), there are three pairs of magnetic field insulators (7) surrounding the coil (6) and the water cooler copper coil (5) divided in three segments, the upper segment (5 A) for cooling, the intermediate segment (5 C) for working, and the lower segment (5 B) also for cooling.

In order to join the coil (9) to the mold (3), the device has a monolithic refractory joint (1) which forms the discharge channel, with the following characteristics:

High thermal shock resistance.

High abrasive resistance.

High chemical attack resistance, and the following physical properties:

| | |
|---|---|
| Density (gr/cm$^3$): | 2.30 minimum |
| Apparent porosity (%): | 12.0 maximum |
| Compression resistance (Kg/cm$^2$): | 100 minimum |
| Rupture modulus (Kg/cm$^2$) | 35.0 minimum |
| to room temperature: | |
| to 1400° C.: | 35.0 minimum |
| Thermal expansion to 1000° C. (%): | 0.25 maximum |

The upper part of the tundish (8), is surrounded by the metallic container (11), lined with refractory brick (12) joined to the inductor (10).

The inductor (10), is lined with a refractory material (4), which is compatible with the discharge channel (1) and the refractory within the container (11). The inductor (10) also has a refractory protector (3) between the coil (6) and the discharge channel (1).

The subjection plate (2), works as a curb element for the discharge channel (1) and the refractory protection material (3).

What is claimed is:

1. An induction heated horizontal continuous casting device, comprising in combination a tundish opening for receiving steel, an inductor section for inductively maintaining steel temperature, a heating coil externally disposed about the inductor section, a refractory sleeve joint forming a discharge channel for removing liquid steel from the inductor, a water cooled coil array disposed about the inductor and a set of magnetic field insulator surrounding the coil.

2. The device according to claim 1, where the joint forming the discharge channel is manufactured of monolithic isostatically pressed refractory material.

3. The device according to claim 1, where the water cooled coil array is divided in three segments, namely upper and lower segments for cooling, and an intermediate segment for working.

4. The device according to claim 1, where the tundish opening is lined with refractory brick joined to the inductor section.

5. The device of claim 2 wherein said joint further comprises a refractory material having high thermal shock resistance, high abrasive resistance and high chemical attack resistance.

* * * * *